US006581853B1

(12) United States Patent
Huang

(10) Patent No.: US 6,581,853 B1
(45) **Date of Patent: *Jun. 24, 2003**

(54) SPRINKLER STRUCTURE

(76) Inventor: Dustin Huang, P.O. Box 453, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/120,434

(22) Filed: Apr. 12, 2002

(51) Int. Cl.[7] ..... B05B 15/06; B05B 9/08; B05B 1/30

(52) U.S. Cl. ..... 239/532; 239/530; 239/574; 239/581.1

(58) Field of Search ..... 239/530, 532, 239/574, 581.1, 525, 587.4, 587.1, 588

(56) References Cited

U.S. PATENT DOCUMENTS

| | | | | | |
|---|---|---|---|---|---|
| 2,144,619 | A | * | 1/1939 | Corley | 239/581.1 |
| 2,289,889 | A | * | 7/1942 | Stick et al. | 239/273 |
| 2,753,219 | A | * | 7/1956 | Matarese | 239/456 |
| 3,083,725 | A | * | 4/1963 | Moen | 137/454.2 |
| 3,412,941 | A | * | 11/1968 | Steinbeck | 239/581.1 |
| 5,031,839 | A | * | 7/1991 | Waldrum | 239/331 |
| 6,216,965 | B1 | * | 4/2001 | Chao | 239/587.4 |
| 6,220,527 | B1 | * | 4/2001 | Chen et al. | 239/532 |
| 6,254,017 | B1 | * | 7/2001 | Kuo | 239/532 |
| 6,471,147 | B1 | * | 10/2002 | Kuo | 239/600 |

OTHER PUBLICATIONS

Huang, Dustin; US patent application No. 10/115,710: Claim 1.*

* cited by examiner

*Primary Examiner*—Michael Mar
*Assistant Examiner*—Darren Gorman
(74) *Attorney, Agent, or Firm*—Harrison & Egbert

(57) ABSTRACT

A sprinkler structure which has an auxiliary flow control valve, a first handle, a second handle, a pivoting member, and a nozzle head. The auxiliary flow control valve is formed of a valve body and a control knob for controlling the water flow of the valve body. The two handles are pivoted end to end. The pivoting member is formed of a connector, a washer, a locating tube, and a spherical joint. The nozzle head is fastened with the spherical joint capable of turning in all direction in the locating tube.

1 Claim, 9 Drawing Sheets

SPRINKLER STRUCTURE

BACKGROUND OF THE INVENTION

1. Field of the Invention

The present invention relates generally to a sprinkler, and more particularly to a sprinkler structure comprising an auxiliary flow control valve, two handles, and a nozzle head adjustable in sprinkling direction.

2. Description of Related Art

A sprinkler structure of the prior art comprises a long tubular handle, a flow control device, and a nozzle head. The prior art sprinkler structure is not well received by the consumer in view of the fact that it can not be easily used and controlled.

BRIEF SUMMARY OF THE INVENTION

The primary objective of the present invention is to provide a sprinkler structure which can be easily used and controlled with both hands.

It is another objective of the present invention to provide a sprinkler structure comprising an auxiliary flow control valve to enhance the function of sprinkling.

It is another objective of the present invention to provide a sprinkler structure comprising two handles, one of which can be rotated to adjust the direction in which the sprinkler structure sprinkles.

It is still another objective of the present invention to provided a sprinkler structure comprising a nozzle head which is adjustable in sprinkling angle.

The features and the advantages of the present invention will be more readily understood upon a thoughtful deliberation of the following detailed description of the present invention with reference to the accompanying drawings.

DETAILED DESCRIPTION OF THE INVENTION

Figure 1:
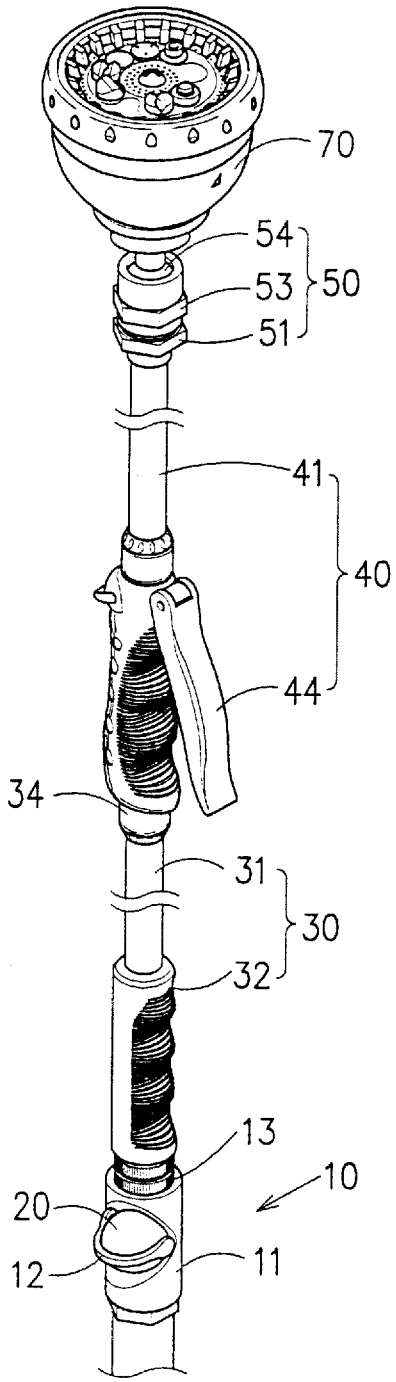
FIG. 1 shows a perspective view of the present invention.
Figure 2:
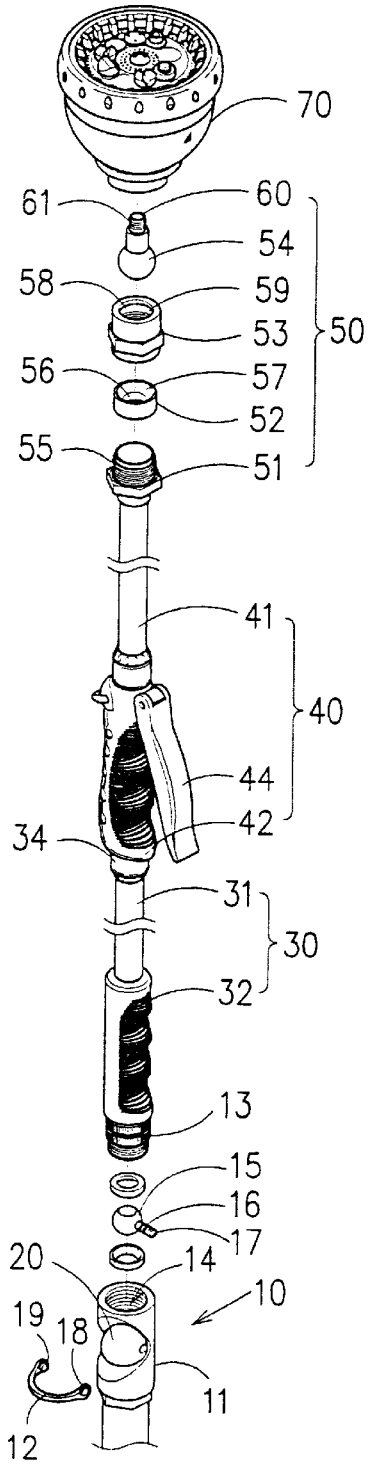
FIG. 2 shows an exploded view of the present invention.
Figure 3:
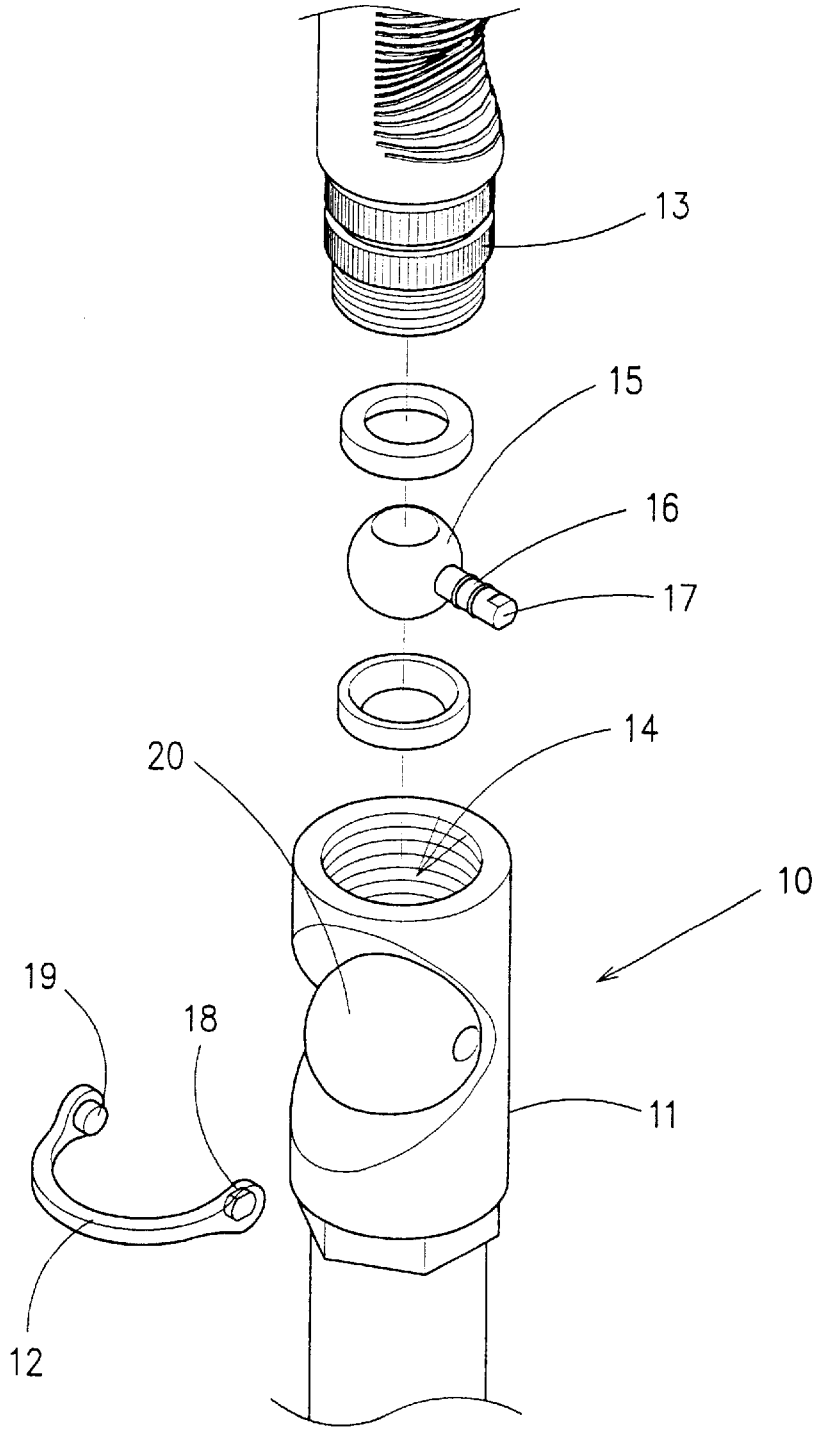
FIG. 3 shows an exploded view of the auxiliary flow control valve of the present invention.
Figure 4:
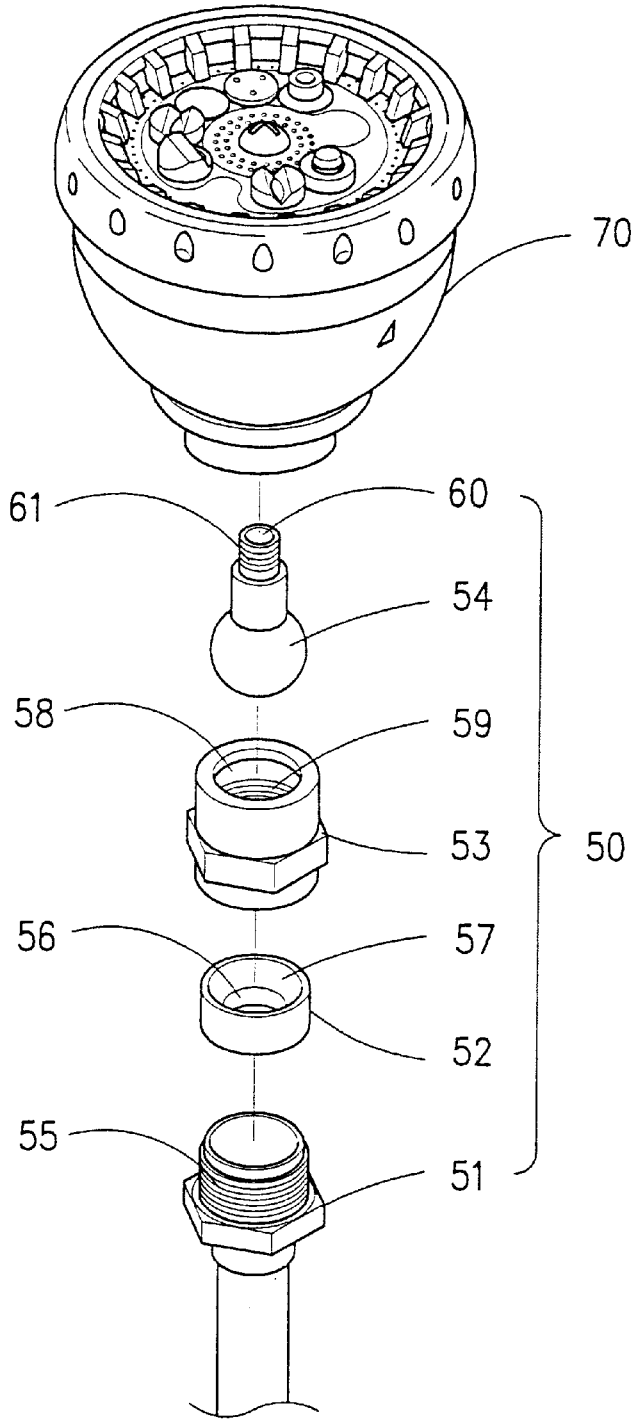
FIG. 4 shows an exploded view of a pivoting member of the present invention.

As shown in FIGS. 1–5, a sprinkler structure of the present invention comprises an auxiliary flow control valve 10, a first handle 30, a second handle 40, a pivoting member 50, and a nozzle head 70.

The valve 10 is formed of a valve body 11 and a control knob 12. The valve body 11 is provided at the top end with a lock ring 13, and in the interior with a receiving space 14 for receiving a ball valve 15. The ball valve 15 is provided with a link rod 16 extending out of the valve body 11 such that its outer end 17 is fastened with one end 18 of a control knob 12. The control knob 12 is provided at other end with a projection 19 which is retained in an axial hole of other side of the valve body 11, so as to form an arcuate face 20 to cooperate with the swiveling path of the control knob 12.

The first handle 30 is formed of a connection tube 31 and a grip tube 32. The first handle 30 is fastened at a threaded portion 33 thereof with the lock ring 13 of the flow control valve 10. The connection tube 31 is provided at the top end with a connection ring 34, an enlarged ring edge 35, and a washer 37 located between the enlarged ring edge 35 and a bottom end 36 of the connection ring 34.

Figure 7:
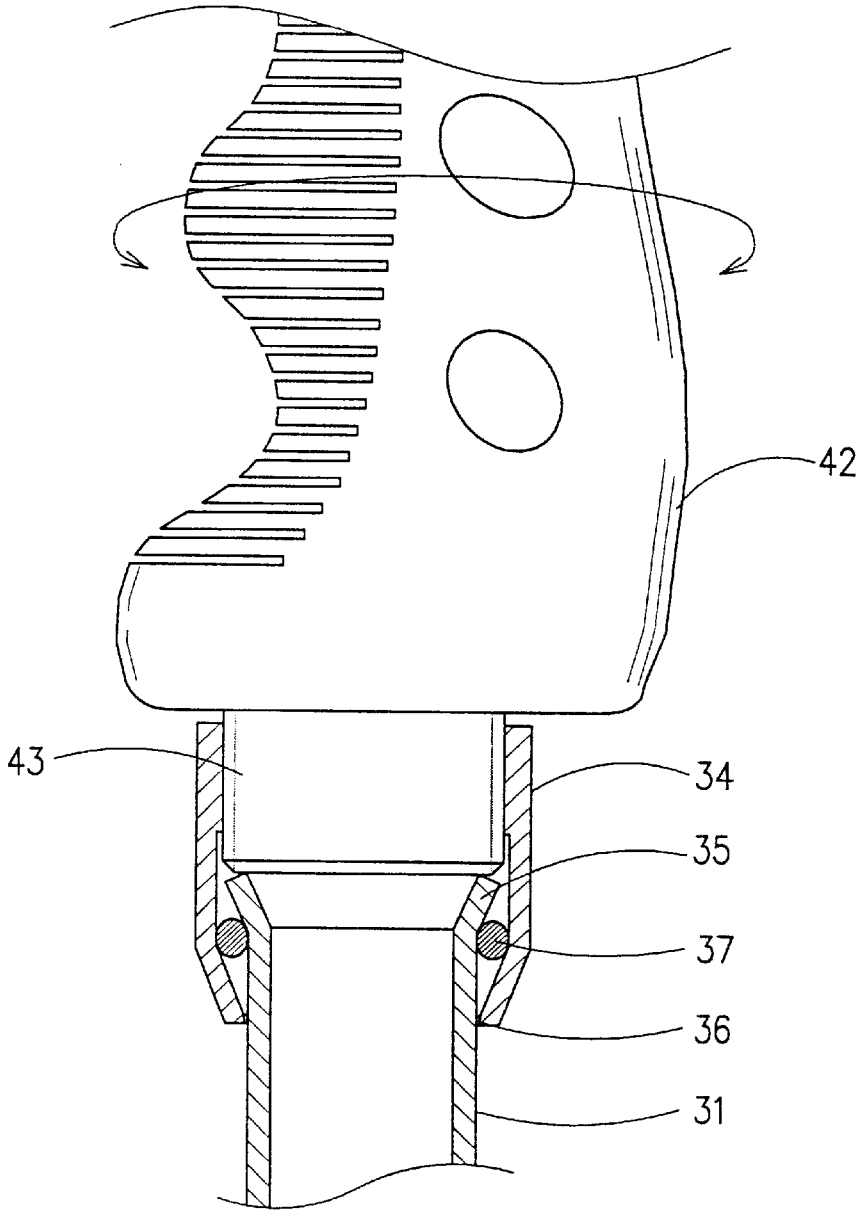
FIG. 7 shows a sectional view of a pivoting portion of the two handles of the present invention.

The second handle 40 is formed of a long tube 41 and a grip tube 42 which is fastened at a bottom end 43 with the connection ring 34 of the top end of the connection tube 31 such that the top end of the connection tube 31 presses against the washer 37. The grip tube 42 is pivoted with a press rod 44 for opening or closing the water path interior of the grip tube 42, as shown in FIG. 7.

Figure 8:
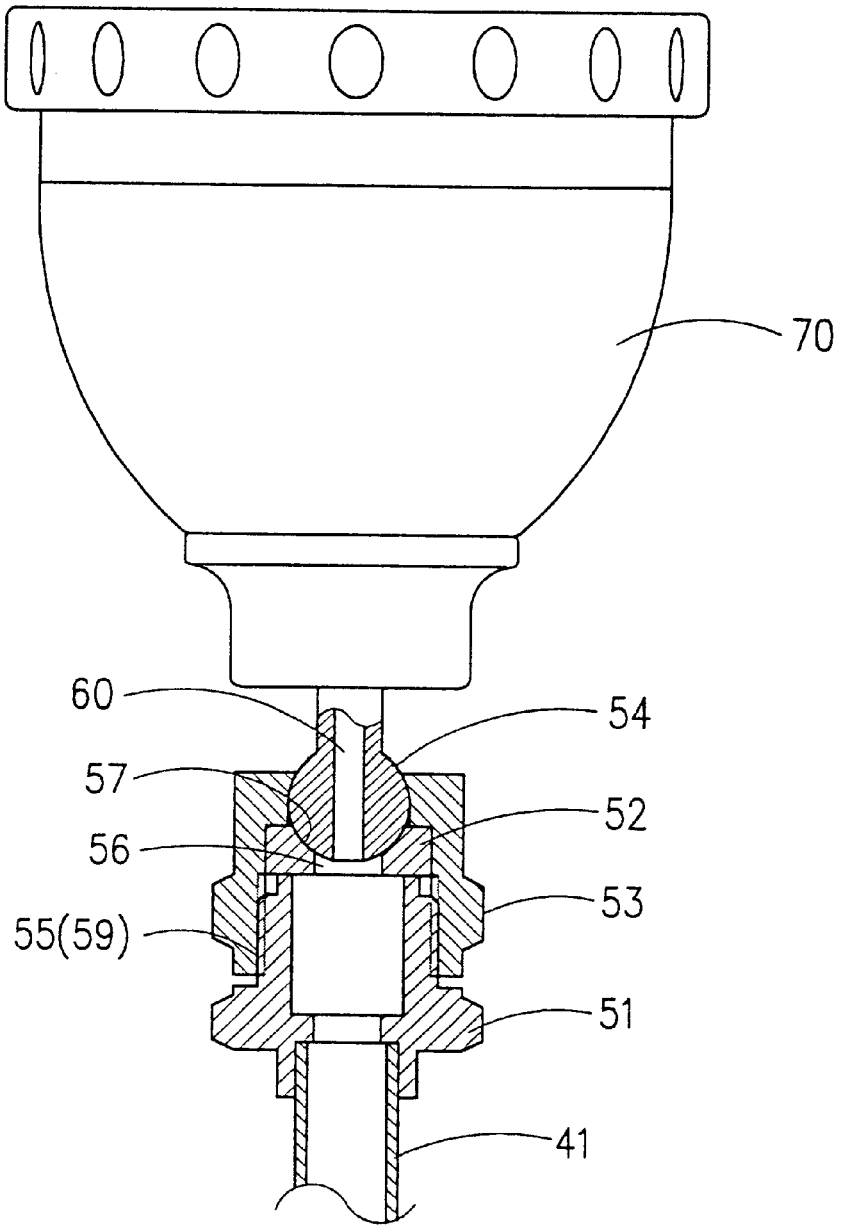
FIG. 8 shows a sectional view of the pivoting member of the present invention in combination.

The pivoting member 50 is formed of a connector 51, a washer 52, a locating tube 53 and a spherical joint 54. As shown in FIG. 8, the connector 51 is fastened at the bottom end with the top end of the long tube 41 of the second handle 40. The connector 51 is provided with an outer threaded portion 55. The washer 52 is provided at the center with a through hole 56, and in the top with an arcuate recess 57. The washer 52 is located at the top of the connector 51. The locating tube 53 is provided at the center with a through hole 58 and an inner threaded portion 59. The spherical Joint 54 is provided at the center with a water admitting hole 60, and at the top with a threaded portion 61. The spherical joint 54 is put into the locating tube 53 such that the outer wall of the spherical joint 54 is in an intimate contact with the inner wall of the through hole 58 of the locating tube 53, and that the top end of the spherical joint 54 is fastened with the locating tube 53, and further that the bottom of the spherical joint 54 is in an intimate contact with the arcuate recess 57 of the washer 52.

The nozzle head 70 is fastened at the bottom end with the threaded portion 61 of the spherical joint 54.

Figure 5:
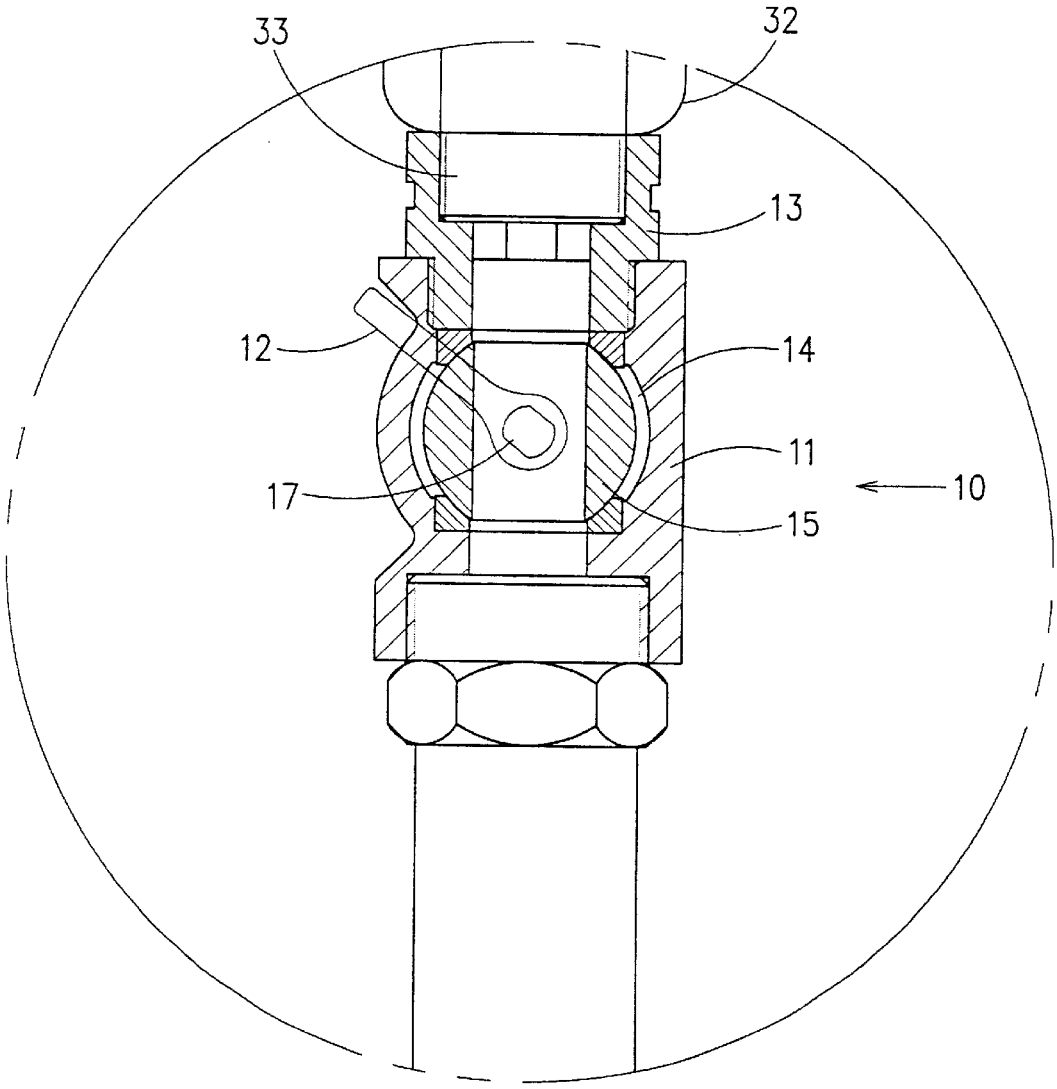
FIG. 5 shows a sectional schematic view of the auxiliary flow control valve of the present invention in combination.
Figure 6:
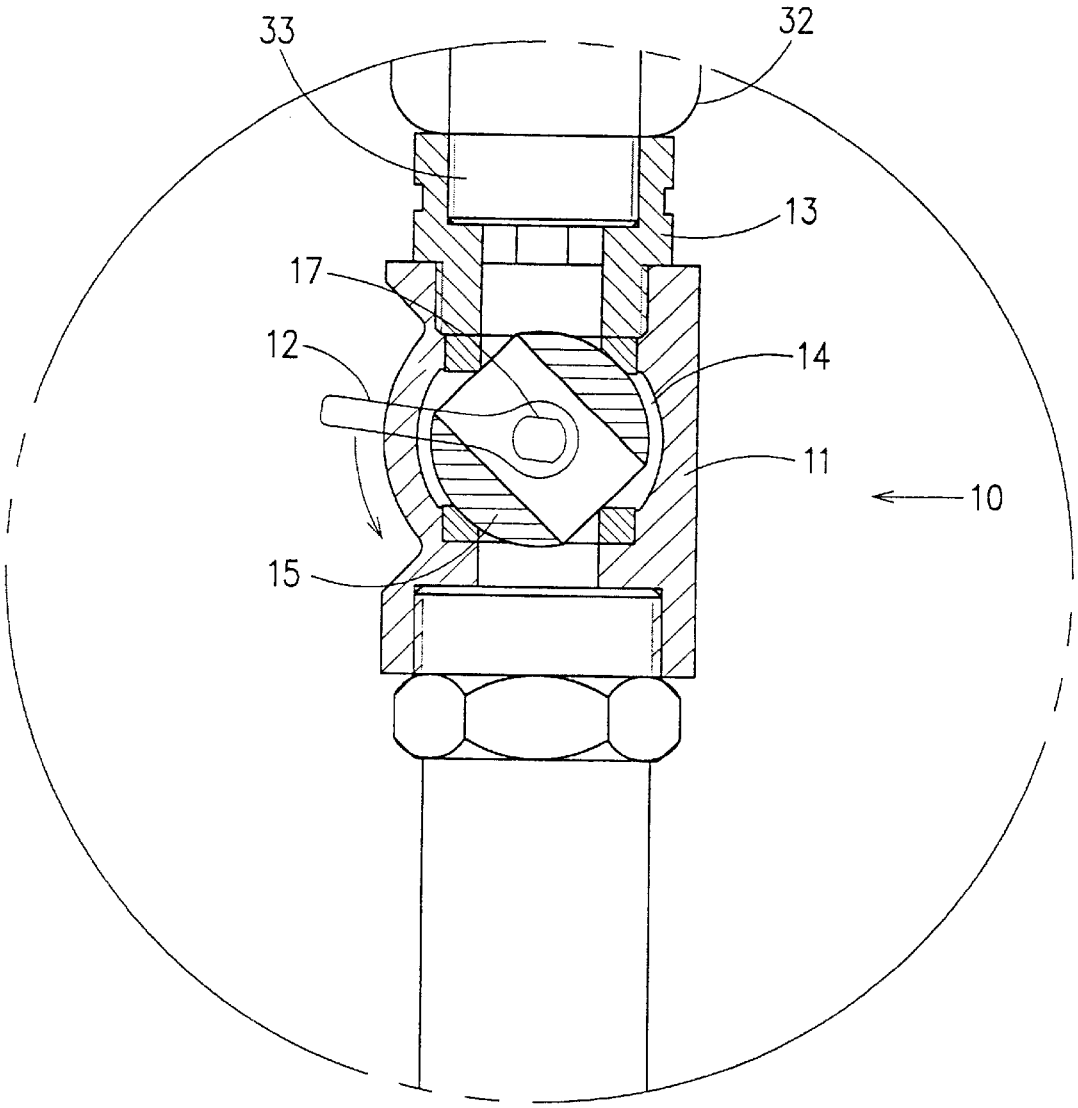
FIG. 6 shows a sectional schematic view of the auxiliary flow control valve of the present invention in action.
Figure 9:
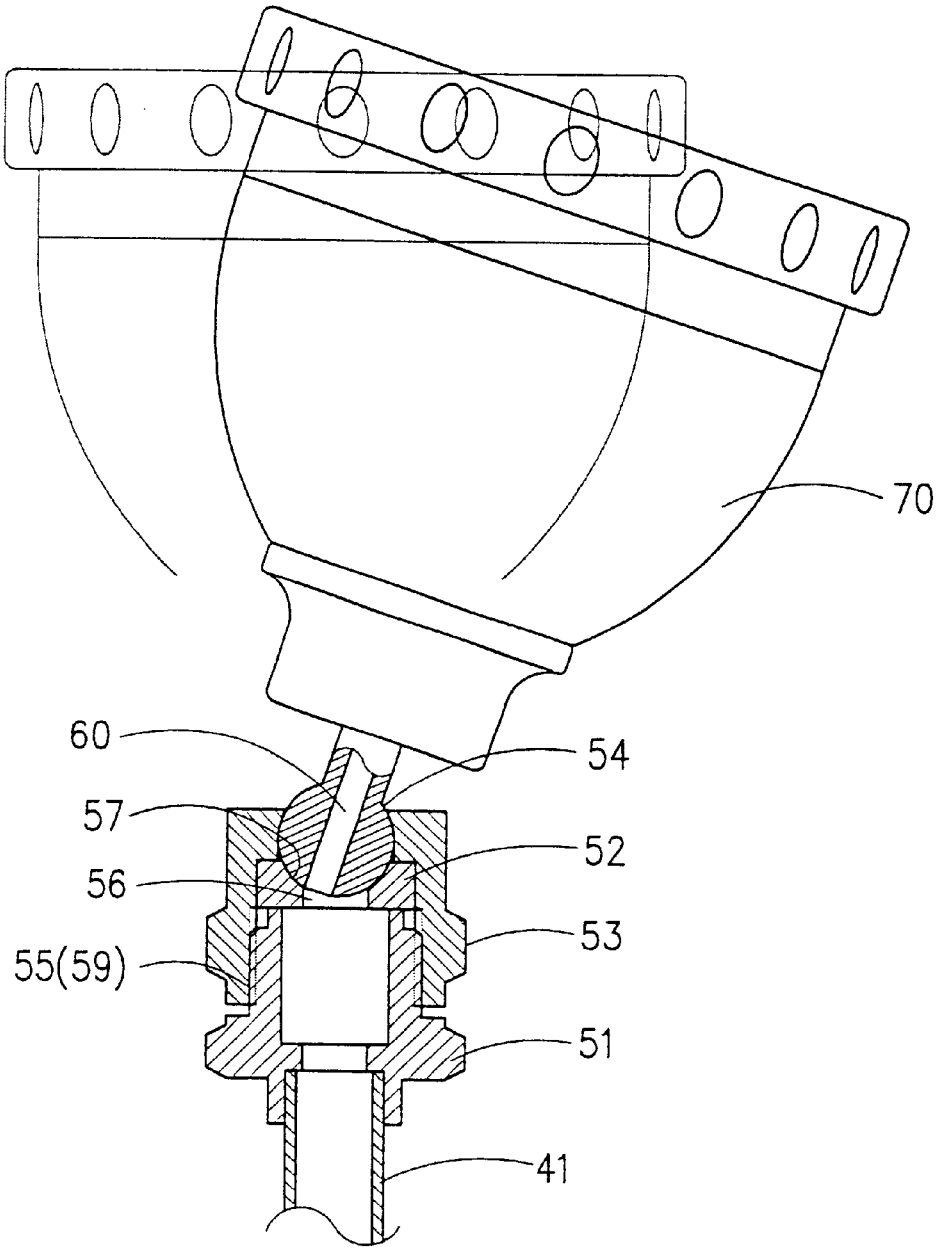
FIG. 9 shows a schematic view of the nozzle head of the present invention being angularly adjusted.

The advantages of the present invention are readily apparent. The present invention comprises two handles to enable the sprinkler to be used with ease. The press rod of the second handle is used to control the water flow. The auxiliary flow control valve is controlled by the control knob 12 is to regulate the flow and the opening or the closing of the valve, as shown in FIGS. 5 and 6. The control knob and the press rod work in a complementary manner. The second handle is pivoted with the first handle such that the second handle can be rotated to adjust the sprinkling direction of the nozzle head. As shown in FIG. 9, the spherical joint 54 is capable of turning in all directions in the locating tube 53 and the washer 52. As a result, the nozzle head 70 can be angularly adjusted.

I claim:

1. A sprinkler apparatus comprising:

an auxiliary flow control valve comprised of a valve body and a control knob, said valve body having a lock ring at a top end thereof, said valve body having a receiving space in an interior thereof;

a ball valve comprised of a link rod, said ball valve received in said receiving space, said link rod having an outer end extending outwardly of said valve body such that said outer end is fastened to one end of said control knob, said control knob having a projection at another end thereof, said projection retained in an axial hole formed in one side of said valve body;

a first handle comprised of a connection tube and a grip tube, said first handle having a threaded portion fastened to said lock ring of said auxiliary flow control valve, said connection tube having a connection ring and an enlarged ring edge at a top end thereof, said connection tube having a washer disposed between said enlarged ring edge and a bottom end of said connection ring;

a second handle comprised of a long tube and a grip tube, said grip tube having a bottom end fastened to said connection ring at said top end of said connection tube such that said top end of said connection tube presses against said washer of said first handle, said grip tube having a press rod-means pivotally attached thereto, said press rod means for opening and closing a flow of water through said grip tube;

a pivoting member comprised of a connector and a washer and a locating tube and a spherical joint, said connector having a bottom end fastened to a top end of said long tube of said second handle, said connector having an outer threaded portion, said washer of said pivoting member having a through hole at a center thereof, said washer of said pivoting member having an arcuate recess in a top thereof, said washer positioned at a top of said connector, said locating tube having a threaded portion, said spherical joint having a water admitting hole at a center thereof and a threaded portion at a top thereof, said spherical joint being rotatably disposed in said through hole of said locating tube such that a top end of said spherical joint is fastened to said locating tube, said spherical joint having a bottom end in intimate contact with said arcuate recess of said washer; and a nozzle head having a bottom end fastened to said threaded portion of said spherical joint such that said nozzle head and said spherical joint are rotatable with respect to said locating tube.

* * * * *